United States Patent [19]

Townend

[11] 4,138,833

[45] Feb. 13, 1979

[54] MODULAR BUILDING CONSTRUCTION

[76] Inventor: George F. Townend, 101 Old Point Rd., Deerhurst, Del. 19803

[21] Appl. No.: 672,420

[22] Filed: Mar. 31, 1976

Related U.S. Application Data

[63] Continuation-in-part of Ser. No. 440,189, Feb. 6, 1974, abandoned, which is a continuation-in-part of Ser. No. 302,249, Oct. 30, 1972, abandoned.

[51] Int. Cl.[2] ..... E04G 21/02

[52] U.S. Cl. ..... 52/745; 52/79.14; 264/35

[58] Field of Search ..... 264/35; 52/743, 745, 52/747, 79, 236

[56] References Cited

U.S. PATENT DOCUMENTS

| | | | |
|---|---|---|---|
| 2,806,277 | 9/1957 | Hand | 52/612 |
| 3,331,170 | 7/1967 | Lowe | 52/79 |
| 3,399,505 | 9/1968 | Comment | 52/743 |
| 3,990,193 | 11/1976 | Ray | 52/745 |

FOREIGN PATENT DOCUMENTS

| | | | |
|---|---|---|---|
| 138249 | 8/1950 | Australia | 52/79.5 |
| 802658 | 7/1951 | Fed. Rep. of Germany | 52/236 |
| 2210342 | 9/1973 | Fed. Rep. of Germany | 52/79.11 |
| 2349865 | 4/1975 | Fed. Rep. of Germany | 52/743 |
| 1269080 | 10/1959 | France | 52/236 |
| 644890 | 10/1950 | United Kingdom | 52/79.14 |

*Primary Examiner*—Ernest R. Purser
*Assistant Examiner*—Henry Raduazo
*Attorney, Agent, or Firm*—Connolly and Hutz

[57] ABSTRACT

Building construction from modules of inverted U shape a full story high with a span of 10 to 30 feet and a depth of 2 to 6 feet. The modules may be monolithic such as of reenforced concrete or plastic foam, or may be of light weight hollow metal construction, assembled together with partitions and end panels. Cast modules can be cast between thin previously formed sheets held by framework to form casting mold, the sheets becoming surfaces of the module.

2 Claims, 13 Drawing Figures

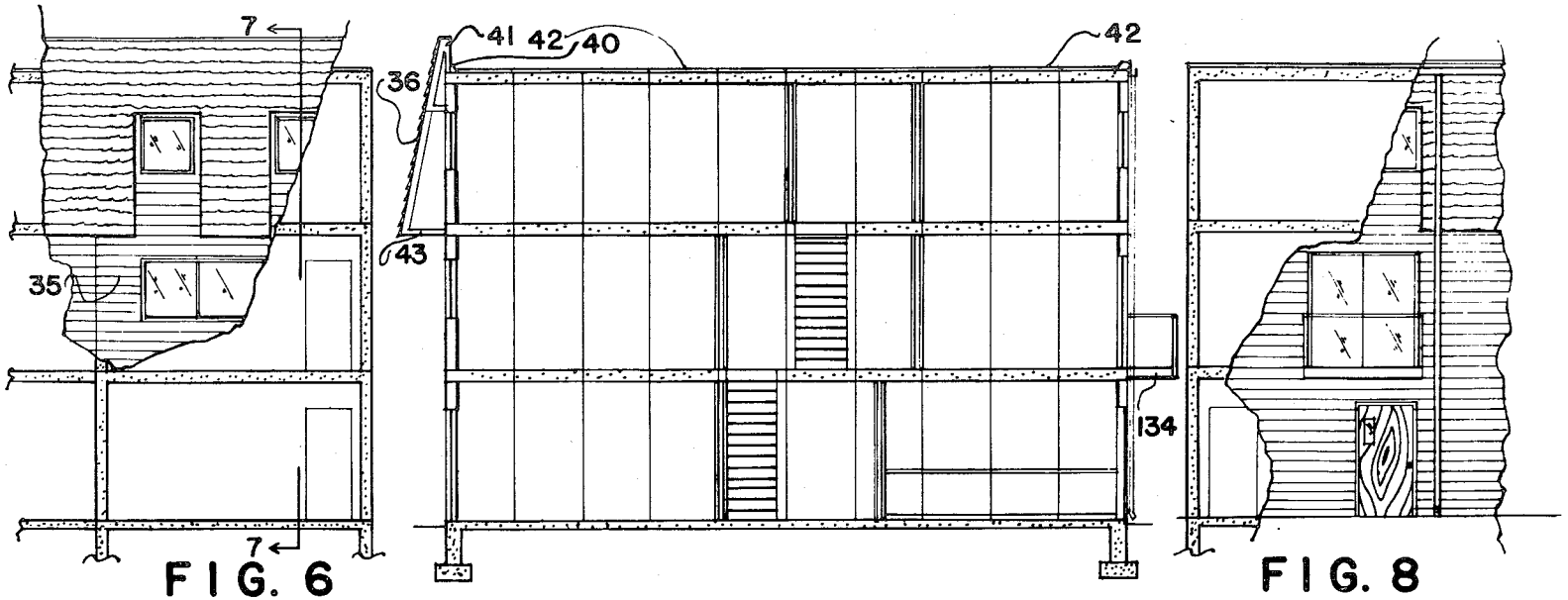
FIG. 6
FIG. 7
FIG. 8
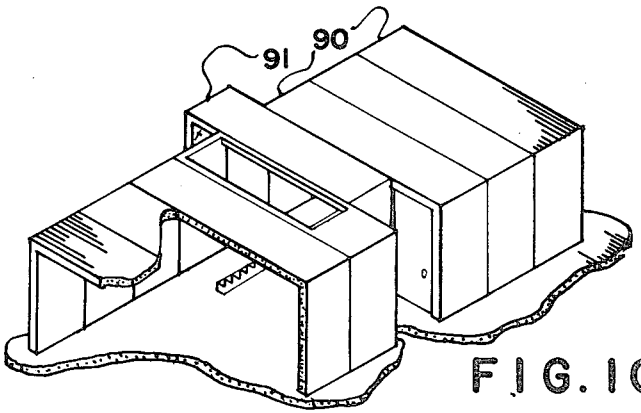
FIG. 10
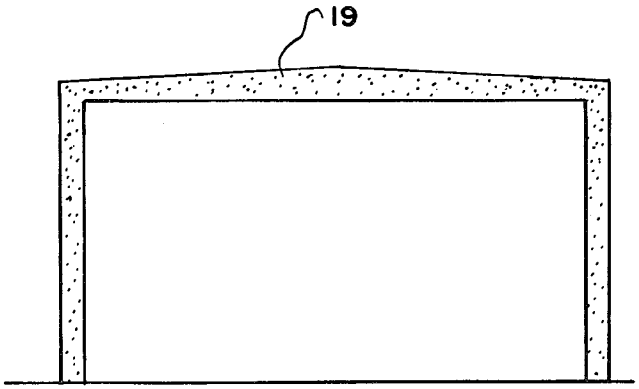
FIG. 9

MODULAR BUILDING CONSTRUCTION

This application is a continuation-in-part of application Ser. No. 440,189 filed Feb. 6, 1974 now abandoned, which in turn is a continuation-in-part of application Ser. No. 302,249 filed Oct. 30, 1972 and now abandoned.

The present invention relates to the construction of buildings, and more particularly to such construction in which there is utilized a series of identical or substantially identical modules or building units, each of which contributes a unit of building volume to the entire construction.

Among the objects of the present invention is the provision of novel modular building constructions that use modules relatively simple to make and assemble.

The foregoing as well as additional objects of the present invention will be more fully understood from the following description of several of its exemplifications, reference being made to the accompanying drawings wherein:

FIG. 6 is a front view partly broken away of a three-story home constructed of modules of the type shown in FIG. 1;

FIG. 7 is a vertical section of the construction of FIG. 6, taken along line 7—7;

FIG. 8 is a rear view of the construction of FIGS. 5 and 6;

FIG. 9 is an elevational view of a modified module pursuant to the present invention;

FIG. 10 is a view similar to FIG. 2 of a modified construction according to the present invention;

According to the present invention a self-supporting building unit or module is in the shape of an inverted U having legs at least a full story high, a span of about 10 to about 30 feet between the legs, and a depth between about 2 and about 6 feet.

Figure 1:
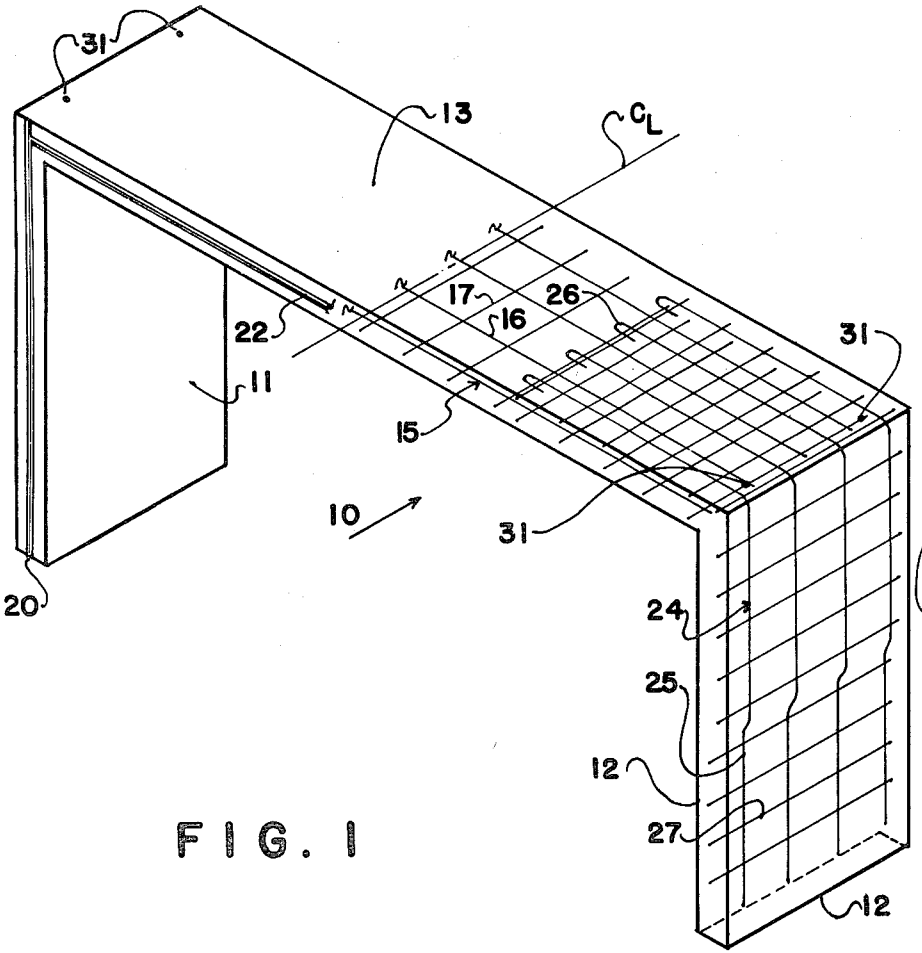
FIG. 1 is an isometric view of a building construction module of the present invention, with a portion shown in skeletal condition.

FIG. 1 is such a precast reenforced one-piece concrete module 10 with two legs 11, 12 spanned by a top 13. This module is provided with a groove 20 about ¼ to about ¾ inch deep in one edge face of each leg 11, 12, to receive caulking or other joint sealing filler. A similar groove 22 is in the corresponding edge face of top 13. Groove 20 runs to the very top and bottom of the module, but groove 22 can terminate at groove 20 so that it does not reach the outside faces of the legs. The caulking grooves can be on both faces of the module, although it is enough to have them on only one face. By having groove 20 extend to the very top face of the module, caulking can be forced in from the top after modules are brought into face-to-face engagement. Groove 22 can have caulking forced in it from groove 20, although groove 22 can alternatively extend to the end faces of legs 10, 11 so that a caulk-introducing tube can be inserted from either end of this groove.

Instead of introducing the caulking after the modules are juxtaposed, a caulking or yieldable rubber seal strip can be fitted into the grooves 20, 22 at one edge face of a module and the adjacent module then placed against it so as to compress the strip a little and thus seal the joint. With this arrangement the adjacent edges of juxtaposed modules can be spaced from each other by a small amount such as ½ to 1 inch, and if this space is not completely filled by the caulking strip, additional caulking or grouting can be applied to fill it after the modules are juxtaposed.

FIG. 1 also shows one arrangement for fitting reenforcing in the module so as to assure that it is both strong and durable. In this arrangement a module having a 16 foot span overall, a 4 foot depth, and an eight inch wall thickness has three reenforcing webs. One web 15 extends across the module top about two inches above its lower face. This web has long No. 4 reenforcing bars 16 extending to about 3 inches from each end of the span, and spaced on 1 foot centers, tied to short cross bars 17 extending to within about ½ inch from the caulking groove bottoms. The cross bars 17 in the central portion of the span are No. 4 bars on 1 foot centers, but at the ends of the span are No. 3 bars 12 inches part. All ties can be with No. 16 wire, but can be replaced by welds.

Extending up each leg of the module and over about ⅓ of the span is another web 24. Each of these webs has a series of long No. 4 bars 25 spaced on one foot centers, running from about 3 inches above the lower end of each leg to the leg top where they bend over and run along the span about 2 inches below the upper surface of the span. At their upper end these bars are curved down and back as shown at 26. Cross bars 27 spaced on 10 inch centers are tied to the long bars 25 in webs 24, and are No. 4 size along the legs, but No. 3 size along the span. Through the lower half of each leg, web 24 is located at about the center of the leg thickness, but above that, web 24 is bent outwardly so as to run about two inches from the outer surface of each leg.

Changing the length of the span or the depth of the module will affect the reenforcement and may call for more or fewer bars of different sizes and spacings. The three reenforcement webs illustrated can be out of contact with each other, but they can also be linked together if it is desired to have a single cage of webs to be handled as a unit.

Module 10 also has four lifting elements cast into it. These elements are shown as threaded sockets 31 which can be standard single leg threaded lifting inserts and into which eye bolts can be threaded. A cable hooked to these eye bolts enables simple lifting, erecting and positioning of the module with a crane or similar lifting device.

Figure 2:
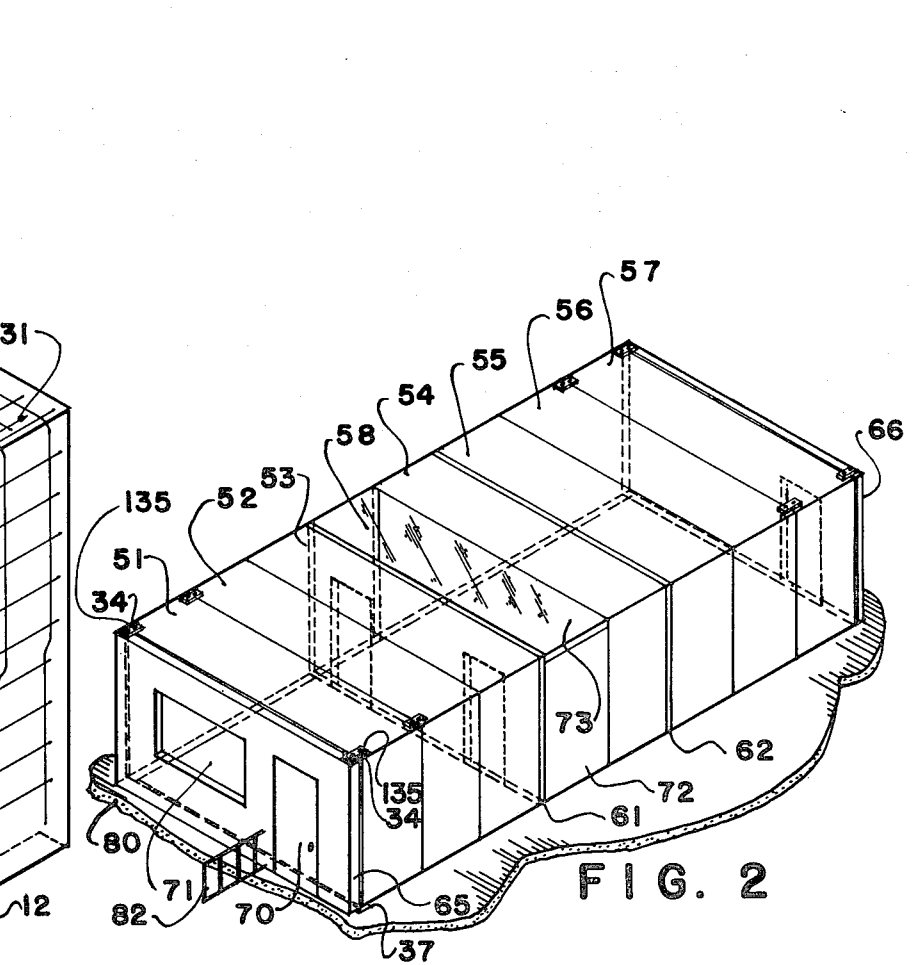
FIG. 2 is an isometric view of a one-story home built with modules of the type shown in FIG. 1.

FIG. 2 shows a series of modules 51 through 57 arranged to provide a relatively small one-story home that can be of the row, semi-detached, or fully detached types. The modules are juxtaposed in alignment, and panels such as interior partition panels 61, 62 having the same outside height and span as the modules can be fitted between them where such partitions are desired. Similar face or outside panels 65, 66 can be used to close the ends of the row. The panels can have doorways, arches, windows, ventilators, air conditioners, heaters or the like fitted in them. Thus face panel 65 has a door 70 and a picture window 71, whereas partition panel 61 merely has two doorways.

It is not necessary for the entire structure to be of U-shaped modules. In the construction of FIG. 2 a three-piece unit 58 consisting of separate legs 72 and a span plank 73 is fitted in the row of modules. Legs 72 can be of translucent construction or fitted with ordinary window sash or the like, as can span plank 73, thus providing extra light in the interior of the home.

The construction of FIG. 2 is built on a flat floor such as a concrete slab 80. The modules are easily lowered into position, with the interior panels 61, 62 positioned the same way. The three piece unit 58 can be provided as by first slipping legs 72 down in the caulking grooves of the adjacent modules or panels, these legs 72 being shaped so as to project somewhat into and partially fill those grooves. For this purpose the caulking grooves can be relatively deep, that is ¾ inch in depth or even more. Enough unfilled space can still be left in those grooves to receive caulking, and before or after the caulking is completed there, the span plank 73 can be lowered over the tops of the legs. The legs 72 are locked in place in the grooves of the adjacent members by the weight of the span plank 73, and the entire construction is tight.

The panels 61, 62, 65 and 66 need not be of concrete construction, but can be hollow, of stamped and studded metal for example, with or without caulking grooves to mate with those of the modules. The outer or face panels can be secured to the modules they engage as by means of plates 34 spanning from the panel to the nearest lifting socket 31, screws 35 passing through holes in the plates and threaded in those sockets. The outermost modules can be similarly secured to their adjacent modules. The outer panels can also be cemented in place as with standard mortar, or with epoxy cement or the like. External bracing can also be used, and the panel can provide an anchorage for other members such as hand rail 82. The lower edges of the outer panels can in addition be tack welded to anchor plates 37 cast in floor slab 80 to help secure the panels.

It is not necessary to use panels that abut the edge faces of the modules. End panels can be fitted within the modules flush with the module edge faces, or even recessed, and can be wedged, nailed, screwed or cemented in place.

All the plumbing, heating, and cooling facilities can be built into the floor slab 80, to simplify the modular construction. However, simple wall segments like leg 72 of unit 58 can be provided with plumbing and/or other conduits if desired, or even with vents, so that these conduits or vents need not be placed over the inside faces of, or in the walls of, the U-shaped modules. Overhead lighting and electrical plug-in receptacles can be provided in the end and intermediate panels, and where the interior surfaces of the modules are covered by finishing panels, in those finishing panels as well.

The floor slab 80 can be laid over a basement type enclosure that provides additional room for the home. Even without a basement, the construction of FIG. 2 makes an adequate home with modules having a depth of about 4 to 5 feet and a span of about 16 to 20 feet. Modules not over 5 feet in depth are much easier to build and assemble and give more versatility in selection of room depths, than 6 foot deep modules.

Figure 3:
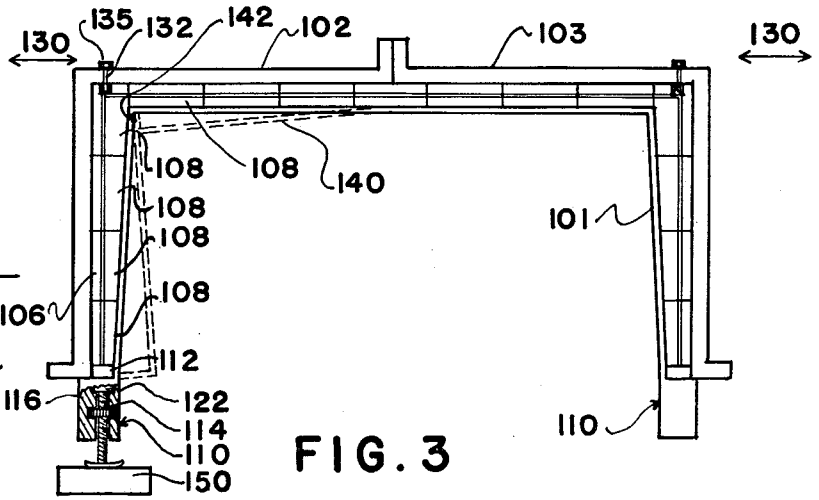
FIG. 3 is a plan view of a casting mold for casting a module of the type shown in FIG. 1.

The module casting arrangement of FIG. 3 uses a multipart form having an inner form member 101, two outer half members 102, 103, a lower support member 106 as well as a corresponding upper member not shown. Inner member 101 determines the configuration of the interior surface of the module as well as the lower edge faces of the legs, and the outer members the external U-shaped surface of the module, while the upper and lower members determine the remaining edge faces.

Inner form member is shown as including power mechanism 110 for pulling it from the cast module, such mechanism including a push bar 112 for each leg, carried by a threaded drive rod 114 on which is threadedly engaged a worm gear 116 the outer periphery of which is driven by a worm (not shown) rotated by a reversing electric motor (also not shown) mounted on a block 120 secured to the ends of form member 101. The drive rod 114 has a portion 122 of its length square in transverse section and engaged in a closely fitting square passageway in block 120 to keep the rod from rotating with the wormgear 116, but permitting the rod to move longitudinally through the block.

The outer form members 102, 103 can also be similarly power driven in the direction of arrows 130 for example, to help pry them from the casting as well as from each other.

Inner and outer members can be of metal plate construction with their form surfaces coated with a mold release such as a fused-on polyethylene layer so that the freshly cast concrete of the module does not adhere strongly to them. Lower and upper form members can merely be a series of polyethylene blocks 108 shaped to provide the caulking grooves for the module. Outer form members 102, 103 can carry steam jacket passageways for circulation of steam to heat the form and accelerate the setting of the cast concrete. These outer members can also have openings 132 through which screws 135 pass to threadedly engage the lifting sockets 31 which can be separate from or tied to the internal reenforcement cage for the cast module.

The casting operation can be carried out by assembling the outer and lower form members, mounting the reenforcement members and the screws 135, assembling the inner form member to the others, pouring the concrete into the thus-prepared mold, vibrating the assembly to settle the concrete and drive out air bubbles, then placing the upper form member over the top of the form, and permitting the concrete to set with or without heating. Waterproofing agents such as silicone resins can be added to the concrete mixture poured into the mold, or can be coated on the finished module.

When the setting of the concrete is completed, the screws 135 are removed, the inner and outer form members pried apart, and the upper form member blocks removed. Screw eyes can then be threaded into the sockets from which screws 135 were removed, and the cast module lifted onto its feet as by a crane lifting a cable looped through the screw eyes. The bottom mold member can then be removed from the upright module and the module is ready for installation.

In FIG. 3 the inner form member 101 is shown as having its leg portions inclined apart slightly to provide tapered inside leg surfaces on the module. This helps withdraw the inner form member from the cast module. However, such taper is not needed if for example the inner form member has a built-in curvature as shown by dashlines 140. Such a curved inner form member can be forced into straight shape against the lower form member as by the power mechanism 110 acting against a jam block 150, and additional spacer rods 142 welded to the upper edges of the form members 101, 102, 103 can help hold the upper portion of the curved inner form member parallel to the opposing form members. After casting in such a form assembly, the prying action on inner form member 101 to pull it from the cast module will permit that member to return to its curved configuration thus shortening the span of the form member slightly and permitting it to be easily removed even though the module legs are not tapered.

The casting can be carried out at the construction site, or in a casting plant from which the modules are transported to the site. The casting equipment can for example be mounted on the bed of a truck that can be brought to or near the construction site, and the casting effected on that truck bed. The same truck that carries the casting equipment can also be equipped with a crane to lift the cast modules and lower them in place.

Figure 4:
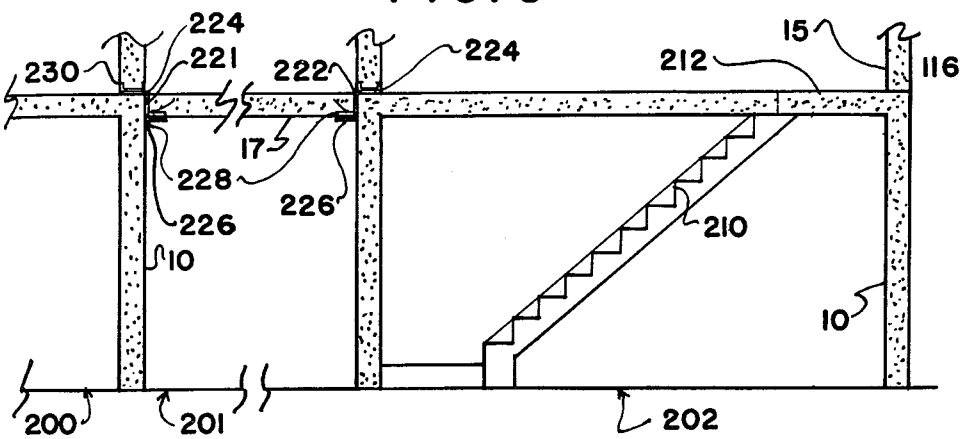
FIG. 4 is a front view of two spaced rows of modules with the space between the rows covered to effectively make a third row of modules, a stairway being also illustrated in one of the rows.

A row of attached houses pursuant to the present invention is shown by the diagrammatic vertical section view of FIG. 4. One house 200 is built of a set of modules 10 as in the construction of FIG. 2 for example. Another house 202 can be of similar construction with modules 10 forming one story, and another set of modules 15 placed above the first set 10 to form a second story. A stairway 210 is incorporated in or attached to one of the first story modules, as by being formed integrally with one leg of the module, connected to that leg by a landing floor portion 212. The remainder of the span of the staircase module can be left entirely open, with an extra vertical panel filling the vertical wall to the left of the staircase. Alternatively integral or separate reenforcing lengths of concrete or steel or both can extend along the span of the staircase module to connect its two vertical legs together.

For modules of relatively short span such as less than sixteen feet, the stairway is best provided with extra steps at its upper and/or lower landings, which extra steps run at right angles to the main flight of the staircase. In FIG. 4 such a step is shown at both landings.

Between houses 200 and 202 is another house 201, but this need not have any U-shaped modules. Instead it is shown as composed of reenforced concrete planks 17 laid between the upper corners of the modules 10 on each side. Angle bars 221, 222 have vertical flanges nailed or bolted to the concrete of the modules or can be provided with ears 224 bolted to the threaded lifting sockets, and have lower horizontal flanges 226 extending out from each adjacent module 10 to carry the ends of planks 17. If desired, the planks can have metal support plates 228 cast in place to engage the supporting flanges 226. A stairway can be provided for house 201, as by substituting for one of the planks 17 a staircase module 210 as in house 202. Such substitution calls for a vacant vertical wall leg in one of the adjacent houses, such as would be found where the adjacent house also has a staircase module.

To provide an upper story for houses 201 and 202, any modules mounted over the top of a securing ear 224 can have the bottoms of their legs fitted to engage those ears, as by casting a metal shoe 230 of shallow channel stock into the leg bottoms, and perforating the shoe to make room for the bolts that hold the ears. After mounting the upper modules their shoes can be tack welded to the flanges of the ears to help tie together the construction. A similar tack welding can be used at the bottom of ground level modules, to anchor plates such as 37 referred to in connection with FIG. 2. Recesses can be provided in the lower and outer portions of each leg for receiving anchoring members projecting up from a lower module or from a ground slab, and these anchoring members can be secured to the legs.

Figure 5:
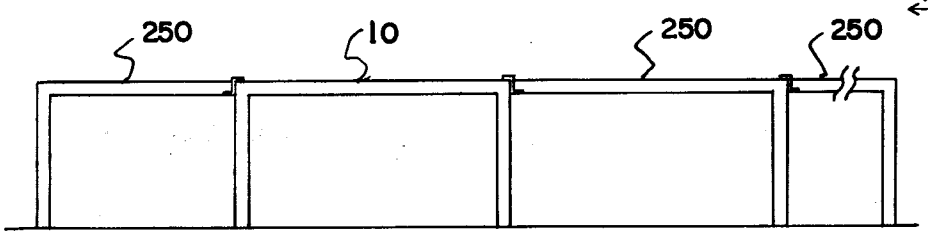
FIG. 5 is a view similar to that of FIG. 4 showing a modified construction.

Instead of having row houses as in FIG. 4, they can be made with one U-shaped module type house to one or both sides of which are attached one or more sets of L-shaped modules 250 as in FIG. 5.

FIGS. 6, 7 and 8 show a three-story row house pursuant to the present invention. Its features are similar to those of FIGS. 2 and 4, and include stairways, partitions, outer panels, windows, and even a balcony 134 formed as part of an outer panel.

Decorative clapboard 35 or other sidings may be applied to the outer walls and panels for architectural effect, and a shingled false roof 36 may be attached to the upper modules for decorative effect.

The roof is shown as flat with a flashed cant strip 40 against an upright support 41 for the false roof. A built-up roofing layer 42 covers the tops of all the uppermost modules. False roofing outriggers 43 also help support the architectural shingle 36 roofing effect.

Interior partitions of wood or steel stud with drywall or other interior finishes define interior rooms, closets or other spaces.

Plumbing and electric lines and the like can be brought to the upper stories through special leg panels associated with stairway modules or the like, as described in connection with the constructions of FIGS. 2 and 4.

Although roofing 42 is shown as applied over the top of the construction of FIGS. 6, 7 and 8, to help protect against the weather, such roofing is not needed where the segments are carefully caulked and the concrete adequately waterproofed, and particularly in drier climates. Of course any exposed metal can be protected by painting, or made or weather resistant material such as stainless steel, copper or aluminum. To provide a slope to the roof, particularly in large constructions, the modules can have the upper surface of their span tapered as shown somewhat exaggerated at 19 in FIG. 9. Such taper also helps with the above casting, and can be as little as $\frac{1}{8}$ inch per foot. Where the taper is incorporated in all modules including those for lower floors of a multiple story house, they provide a tapered floor for the upper stories, but such floor taper can be levelled as by filling with a cement layer that leaves the floor flat. A similar filling with cement or plaster can be used to remove any taper from the inside surfaces of the module legs, where no other inside finish is provided.

It is not necessary to have modules all aligned in a straight row. FIG. 10 shows a home construction with a series of modules 90 in which an occasional module 91 is offset or pulled out a little so that it extends a few feet beyond the side defined by modules90. The opposite end of module 91 can then be recessed, and windows and/or doorways fitted in the openings provided by the offsetting.

Figure 11:
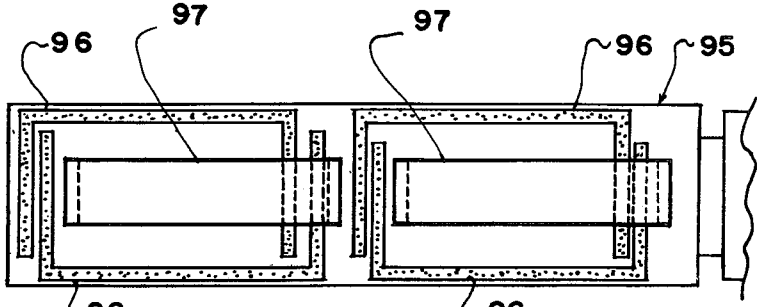
FIG. 11 is a plan view showing a set of modules mounted on a truck bed.

A feature of the present invention is that the concrete modules provide a completely fire-resistant structure, and do so in a very economical manner. Each module is very economical to manufacture and install, so that field construction labor is sharply reduced, particularly roof erecting labor such as for standard roof framing or arches. The absence of protuberances such as ledges or the like from the surfaces of the modules of the present invention is particularly helpful in this connection. The U-shaped modules are small enough to be transported by truck or rail, and can be conveniently fitted in sets on a truck bed less than 9½ feet wide, as shown in FIG. 11. In that figure six 4½ foot deep modules each 16 feet long are mounted on a truck bed 95, 36 feet long. Four modules 96 are lying on their sides with their legs interleaved, and two more modules 97 are standing with their legs in the spaces between the interleaved modules 96. Where the standing modules have a depth of four feet or less, two more such standing modules can be added to the same truck bed, by placing a pair of standing modules 97 having a combined overall depth of no more than eight feet alongside each other in the eight foot wide space provided by the full story height of each pair of interleaved modules 96.

For most purposes the concrete of the modules can be eight inches thick, even in spans of as much as 25 feet, and 10 inches is sufficiently thick for 30 foot spans. For short spans of only 12 feet or so, the concrete thickness can be as little as six inches or even less.

The modular construction of the present invention can be used for apartment buildings, schools, motels, dormitories, libraries, factories, stables, and all kinds of buildings other than houses. Thus three six-foot deep modules having spans of 10 to 12 feet can be assembled to make a very inexpensive carport. Fitted with end panels it becomes an inexpensive garage, although it may then be preferred to have a fourth such module to lengthen the garage. By simply using modules with larger spans, a two-car or three-car garage or carport can be correspondingly built.

Figure 12:
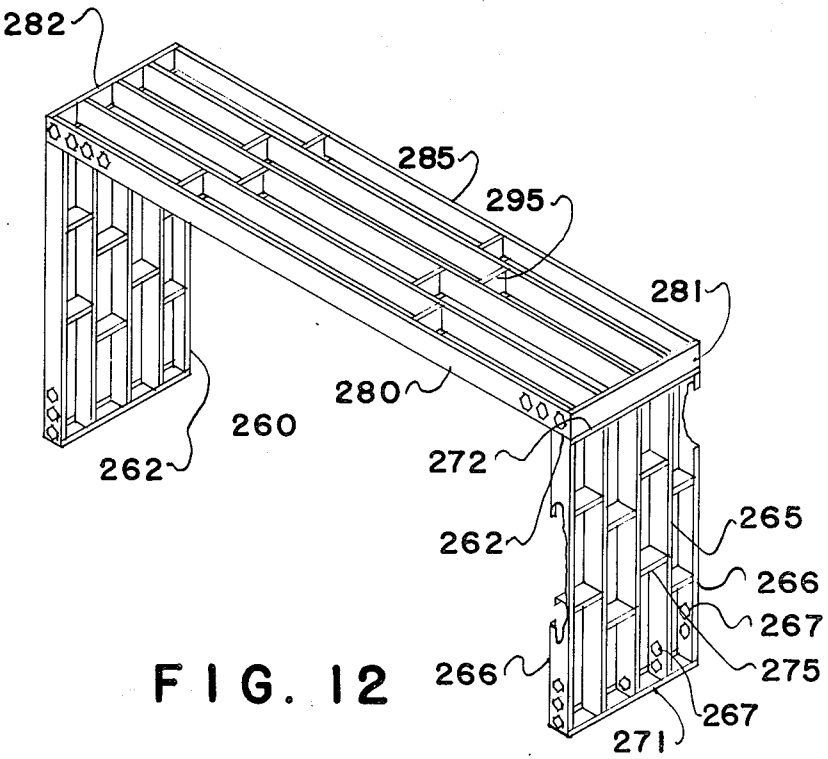
FIG. 12 is an isometric view similar to FIG. 1 of a different type of construction module representative of the present invention.

FIG. 12 shows a different type of U-shaped module 260, made of metal, but also suitable for the constructions described in FIGS. 2, 4, 5 and 10 for example. It is composed of a series of sheet metal channels or studs or the like, secured together and braced as by welding so that it is self-supporting but still very light. Thus a module of this type having an eight foot leg length, a four foot depth, and an 18 foot span weighs as little as 250 pounds when made of steel of approximately 18 gauge. Such a module is easily transported and can be mounted in place by two men who can lift it and simply carry it to the construction site where they merely lower it onto the floor of the construction. A series of such modules so located in juxtaposition can then be readily welded together and very easily finished off with surface panels of plywood, plasterboard, enamelled or porcelained metal or the like, to complete a sturdy construction.

The modules of FIG. 12 preferably are of hollow-wall construction to reduce their weight. They need not be sturdy until finished with surface panels. As illustrated, the module for a 16 foot span overall and a four foot depth, has legs 262 of five 16 gauge six inch wide flange studs 265 punched out at 267 for example to reduce their weight. Studs 265 are spaced twelve inches between centers and welded to bottom and top channels or unpunched six inch wide tracks 271, 272 also of 16 gauge. The webs of studs 265 are notched at the stud ends to make room for the flanges of tracks 271, 272, and the tracks as shown are slightly narrower than the studs 265 so that the tracks fit snugly inside the flanges of the studs. Also the outermost studs 266 of the legs can have their flanges pointed inwardly of the legs so that the legs do not have projecting flanges. Short lengths 275 of 6 inch unpunched metal track also 16 gauge are further shown as welded between adjacent studs 265 to further stiffen the legs.

The span 280 of module 260 is built the same way as the legs, with punched studs 285, and end tracks 281, 282 welded together and stiffened by braces 295, all of 16 gauge. The tops of the legs 262 are welded to the lower surface of the span ends, to complete the assembly of the module.

The welding of the elements of the module of FIG. 11 is conveniently effected by spot welding as they are held in a jig in a manufacturing plant, and the modules then transported to the construction site. If desired extra braces can be removably tack welded or even stapled between the lower portion of each leg and a nearby portion of the span to assure that the modules are not twisted out of shape during the transportation and the erection. These braces are removed after the modules are in place.

As with the modules of FIG. 1, very little erecting labor is needed to build a house or other structure from the modules 260. These modules are simply attached as by bolting to a floor slab or the top of a foundation wall, and secured to adjacent modules as by welding.

The monolithic construction of FIG. 1 can also be made of foamed or unfoamed plastic that provides a shell of insulation to which the building interior finish can be applied. The shell itself can provide the exterior, or be covered. Alternatively, sheets of plastic or other material can be propped up to make the casting surface of a module form in which concrete or other plastic material can be cast to make a module having the sheets adhered to the concrete or other plastic materials to become its surface.

Figure 13:
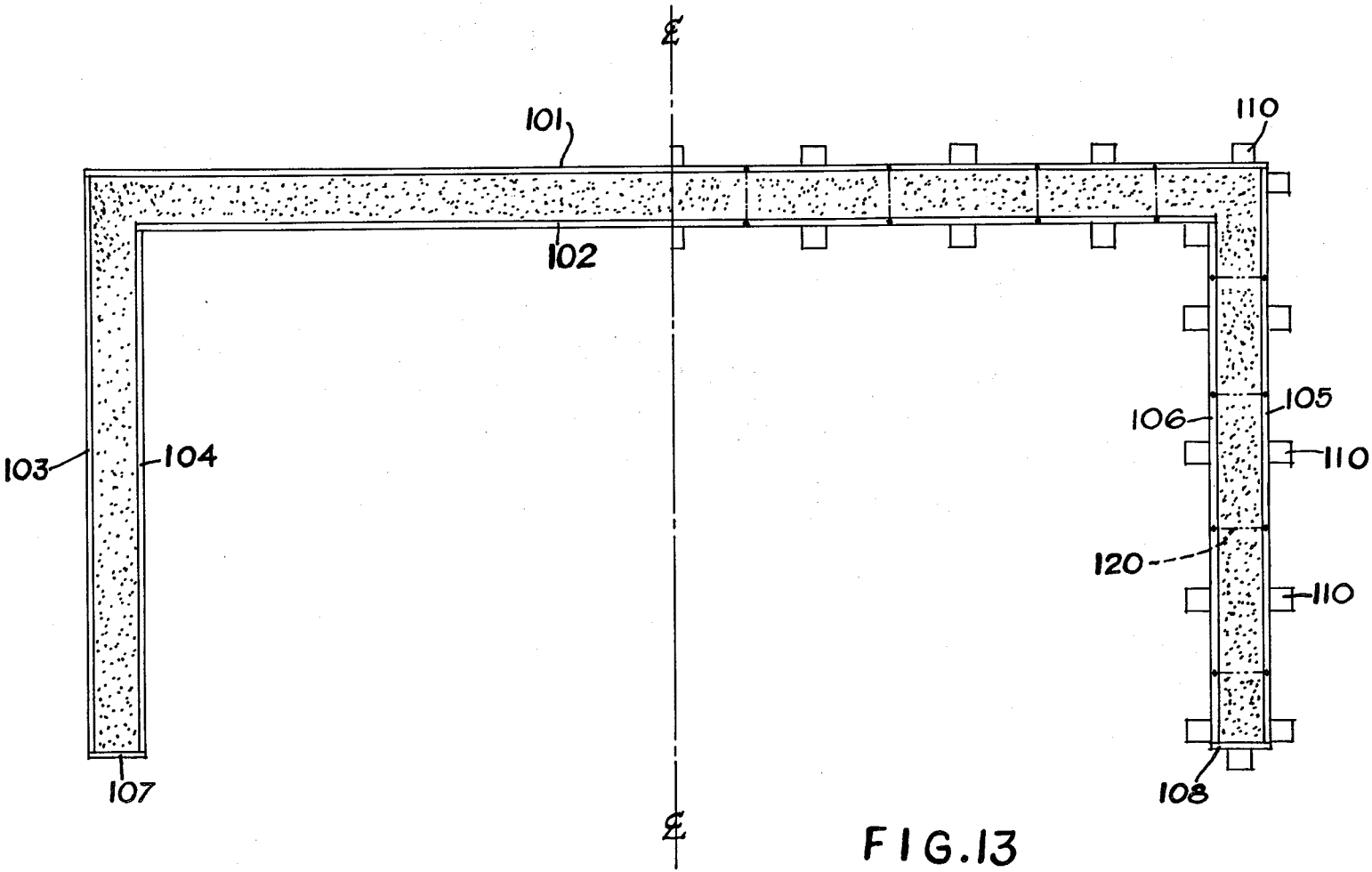
FIG. 13 is a plan view showing casting sheets and supporting frame for casting a module of the type shown in FIG. 1.

Such a casting arrangement is illustrated in FIG. 13 where a set of pre-formed surface panels 101, 102, 103, 104, 105 and 106 each lying on an edge and supported in a vertical plane by spaced bars 110 define the outline of the desired module. These panels are themselves readily cast beforehand as by providing a horizontally extending floor as the casting surface, and affixing to the floor a set of four shallow dams to outline the margins of the panel. Freshly mixed concrete is then poured onto the floor between the dams, tamped or otherwise treated to assure that it is of generally uniform thickness throughout and free of excess porosity, and then permitted to set and cure. A web of reenforcing wires can be locked into the poured concrete, as by first pouring a thin layer on the mold floor, then placing the reenforcing web over that layer, and finally pouring over the web the balance of the concrete for the panel. The reenforcing web can have upstanding loops that project above the upper face of the panel.

Although it is helpful to have the surface of the casting floor fairly smooth so that the bottom face of the panel is also smooth, the top face of the panel need not be smooth, and indeed is preferably left in relatively rough condition. Such a rough surface makes a better bond with additional concrete cast against that surface when the panels, after sufficient curing, are used as the module casting mold as in FIG. 13. Reenforcement loops and the like projecting from the opposed faces of the panels are preferably tied to each other as indicted at 120 before the module casting to improve the reenforcing function and to help hold the panels spaced apart in module molding position. When casting panel 101 which forms the top surface of the final module, the sockets 31 are first laid in place on the casting floor so that they become cast in place in the panel.

For the casting step illustrated in FIG. 13, the floor on which the panel edges are placed can also be relatively smooth and of a material such as polyethylene to which concrete does not bond. Although small panels 107, 108 can be used to define the bottom surfaces or feet of the module legs by becoming cast in place, these surfaces can also be defined by removable blocks made of polyethylene or the like, that do not become cast in place.

Caulking grooves and the like are readily provided during the casting, as by suitably shaping the floor between the lower edges of the mold-forming panels, and by applying over the top edges of these panels, blocks having additional shaping surfaces.

Pouring of a concrete mixture into the mold formed by the panels in FIG. 13, followed by vibration of the poured concrete and then setting, completes the module forming process. The resulting modules are particularly simple to manufacture inasmuch as they have no cast-in-place protuberances. There is accordingly no problem in using a simple panel for each different surface of the module. This simplifies the casting inasmuch as it does not require a casting form with carefully shaped surfaces that engage the poured concrete and which have to be pulled away from the cured concrete. All that is needed is a set of spaced braces against which the molding sheets can be positioned.

Such sheets can be of sound-deadening material, and can also be decorated, as by giving them a wood-grained appearance where they are to form the inside surface of a building constructed of such modules. These sheets can even be made of thin precast concrete or cement panels two inches or less in thickness, where the final module is desired to have such a surface. Reinforcing can be included in such precast sheets, as they are in the panels of FIG. 13, and some or all of the reenforcing members for the entire module can be cast into such sheets or panels, portions of the reenforcing members being embedded within the panels and the remainder being held by the embedded portions so that the sheets or panels are properly located when the concrete is poured against them.

Where flat surface-forming sheets are used, a set of sheets is simply positioned in contact with each other to form the corners of the module. Alternatively, a flat sheet of plastic for example can be bent to make a one-piece corner form, or a special concrete corner surface can be precast and used in the arrangement of FIG. 13. Such a precast corner can be butted against flat panels that outline the adjacent module surfaces. For long spans, a plurality of shorter sheets can also be butted together. A complete assembly of surface-forming sheets can be placed against external braces and the pouring space between the sheets held open by coil springs or the like squeezed between opposing portions of the sheets. The surface-forming sheets can also have cut-outs in which window or door frames are inserted before pouring the interior of the module, thus leaving the frames ready for mounting of windows and/or doors in the legs of the modules or even in their roofs.

Obviously many modifications and variations of the present invention are possible in the light of the above teachings. It is, therefore, to be understood that within the scope of the appended claims the invention may be practiced other than as specifically described.

What is claimed is:

1. A method of making a building module having the shape of an inverted U with legs at least a full story high, a span of about 10 to about 30 feet between the legs, and a depth between about 2 and about 6 feet, which method comprises casting on a plain flat horizontal surface a series of surface panels not over about two inches in thickness, said panels being dimensioned to form the major surgaces of the module, after the case surface panels are sufficiently strong mounting the panels between spaced vertical supports in opposing vertical planes to define an open-ended vertically extending U-shaped cavity, casting setable material in said U-shaped cavity, and when the setable material is sufficiently strong tilting the U-shaped module to inverted U-position for use in a building.

2. The combination of claim 1, in which the panels are cast with internal reenforcement, and the reenforcements of mounted opposing panels are tied together before the balance of the module is cast.

* * * * *